US005660573A

United States Patent [19]

Butt

[11] Patent Number: 5,660,573

[45] Date of Patent: Aug. 26, 1997

[54] ELECTROLUMINESCENT LAMP WITH CONTROLLED FIELD INTENSITY FOR DISPLAYING GRAPHICS

[76] Inventor: James H. Butt, 2121 S. Pennington Dr. #3, Mesa, Ariz. 85202

[21] Appl. No.: 515,873

[22] Filed: Aug. 16, 1995

Related U.S. Application Data

[62] Division of Ser. No. 302,258, Sep. 8, 1994, Pat. No. 5,508, 585.

[51] Int. Cl.[6] ..... H01J 1/70

[52] U.S. Cl. ..... 445/24; 427/66

[58] Field of Search ..... 445/24; 427/66; 40/544

[56] References Cited

U.S. PATENT DOCUMENTS 2,919,366 12/1959 Mash ..... 40/544 X

*Primary Examiner*—Kenneth J. Ramsey

*Attorney, Agent, or Firm*—Paul F. Wille

[57] ABSTRACT

An EL lamp includes a transparent electrode, an electroluminescent dielectric layer overlying the transparent electrode, a patterned insulating layer overlies selected portions of the dielectric layer for reducing the electric field across the selected portions of the electroluminescent dielectric layer, and a rear electrode overlying the insulating layer and the electroluminescent dielectric layer. The insulating layer is preferably a low dielectric constant material and can overlie the electroluminescent dielectric layer or can be located between a separate dielectric layer and a phosphor layer. A gray scale is produced by depositing or printing more than one thickness of insulating layer.

6 Claims, 2 Drawing Sheets

ELECTROLUMINESCENT LAMP WITH CONTROLLED FIELD INTENSITY FOR DISPLAYING GRAPHICS

This application is a division of application Ser. No. 08/302,258, filed on Sep. 8, 1994, now U.S. Pat. No. 5,508,585.

BACKGROUND OF THE INVENTION

This invention relates to an electroluminescent (EL) lamp and, in particular, to an EL lamp displaying a graphics image which is produced by controlling the electric field between the electrodes of the EL lamp.

An electroluminescent (EL) lamp is essentially a capacitor having a dielectric layer between two conductive electrodes, one of which is transparent. The dielectric layer may include a phosphor powder or there may be a separate layer of phosphor powder adjacent the dielectric layer. As used herein, the term "electroluminescent dielectric layer" includes both constructions. The phosphor powder radiates light in the presence of a strong electric field, using very little current. The front electrode is typically a thin, transparent layer of indium tin oxide or indium oxide and the rear electrode is typically a polymer binder, e.g. polyvinylidene fluoride (PVDF), polyester, vinyl, or epoxy, containing conductive particles such as silver or carbon. The front electrode is applied to a polymer film such as polyester or polycarbonate to provide mechanical integrity and support for the other layers.

It is often desired to have an EL lamp produce a graphic image when illuminated, e.g. the numerals in a watch face, a corporate logo or other symbol, or text. These graphics can be produced by patterning one or both electrodes of the EL lamp, forming gaps in the electrodes. Since the lamp operates by virtue of an electric field across the electroluminescent dielectric layer, there must be contact to the electrode over any area which is to be luminous and the bridge between luminous areas is itself luminous. The result is that closed figures, such as a circle, are very difficult to produce and alphanumeric characters appear stenciled. Even if an appropriate design can be made without closed figures, the gap between portions of the electrode produces an undesirable dark line that is often visible even when the lamp is not luminous.

EL lamps having a segmented electrode are known in the art. For example, U.S. Pat. No. 3,813,575—Webb—discloses an EL lamp having a single transparent electrode and a segmented rear electrode. The EL lamp includes seven segments for representing a single digit in an alphanumeric display and each digit requires seven contacts, plus one contact for the front electrode. Providing space for and locating contact areas is often difficult, particularly in applications where space is at a premium such as in a watch face. A minimum number of contacts is preferred.

U.S. Pat. No. 2,928,974—Mash—discloses an EL lamp having a split rear electrode to which the leads of the lamp are attached. The applied voltage is capacitively coupled to the front electrode and the lamp is equivalent to two capacitors in series. Japanese Patent 5-283164, issued Oct. 29, 1993, also discloses an EL lamp having a split rear electrode. A split electrode reduces the number of contacts but raises the voltage necessary to drive an EL lamp to the desired brightness.

A problem with a split rear electrode is that the lamp segments must be of equal area in order to have the same brightness. Obviously, this severely limits the complexity of the graphic. An alternative is to separately power each lamp segment, which would increase the number of contacts and raise the capacitance of the load on a power supply for the lamp segments.

A problem with patterned electrodes is that positive and negative graphics cannot be produced with equal ease. For example, if text is displayed as dark-on-light, then the background is a single lamp. If the same text is displayed light-on-dark, then each character of text is a separate lamp and must be individually connected to a source of power (otherwise the brightness of the letters varies with their area). Thus, inverse or negative graphics are difficult to obtain. This can become particularly troublesome if the reverse of a corporate logo is not a photographic negative (a simple reversal of light and dark); i.e. either version of the logo may require a plurality of individual lamps.

A graphic can be added to an EL lamp by printing opaque material on the outer or front surface of the lamp, overlying the transparent electrode. A problem with this construction is that the graphic is always visible. Many customers for EL lamps want a graphic visible only when the lamp is lit.

In view of the foregoing, it is therefore an object of the invention to provide an EL lamp which can produce complex graphic images and can be constructed with continuous electrodes, i.e. with electrodes which are not patterned or segmented.

Another object of the invention is to provide an EL lamp which can display a graphic including intermediate brightness levels as determined by the desired graphic, i.e. the lamp can produce a gray scale.

A further object of the invention is to provide an EL lamp which can produce shades of gray independently of the area of each shade.

Another object of the invention is to provide an EL lamp in which separate lit areas have the same brightness, regardless of area.

A further object of the invention is to provide an EL lamp having continuous electrodes and areas of different brightness.

Another object of the invention is to provide an EL lamp which displays a graphic only when lit.

A further object of the invention is to provide an EL lamp which can produce positive and negative graphics with equal ease.

SUMMARY OF THE INVENTION

The foregoing objects are achieved in this invention in which an EL lamp includes a transparent electrode, an electroluminescent dielectric layer overlying the transparent electrode, a first insulating area overlying a portion of the dielectric layer for reducing the electric field across a portion of the dielectric layer, and a rear electrode overlying the insulating area and the dielectric layer. In accordance with a preferred embodiment of the invention, the insulating area is a low dielectric constant material. A gray scale is produced by depositing or printing more than one thickness of insulating area, e.g. by depositing or printing successive areas which cover less than all of the preceding areas. In an alternative embodiment of the invention, the insulating areas are the same material as the dielectric material in the electroluminescent dielectric layer. In a preferred embodiment of the invention, the insulating areas overlie the electroluminescent dielectric layer. In an alternative embodiment of the invention, the insulating areas are between the dielectric layer and the phosphor layer. In accordance with another aspect of the invention, a pre-patterned sheet of insulating material can be applied to the electroluminescent dielectric layer to form the insulating areas.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
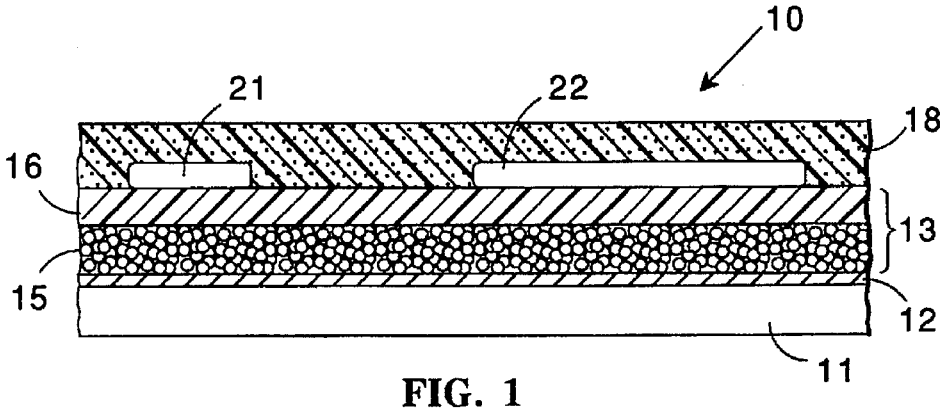
FIG. 1 is a cross-section of an EL lamp constructed in accordance with a preferred embodiment of the invention.

FIG. 1 is a cross-section of an EL lamp constructed in accordance with a preferred embodiment of the invention. Lamp 10 includes transparent substrate 11 of polyester or polycarbonate material. Transparent electrode 12 overlies substrate 11 and includes indium tin oxide or indium oxide. Electroluminescent dielectric layer 13 includes phosphor layer 15 and dielectric layer 16. Overlying dielectric layer 16 is rear electrode 18 containing conductive particles such as silver or carbon in a resin binder. As described thus far, the construction of lamp 10 is conventional.

In accordance with one aspect of the invention, prior to applying rear electrode 18, an insulating layer is selectively deposited on dielectric layer 16 forming insulating areas 21 and 22. The deposition is preferably done by printing a suitable ink to form a chemically stable islands or areas of insulation. Insulating areas 21 and 22 represent two of several areas which may be used to provide the desired graphics. Suitable inks include solvent inks which are air dried or oven dried, such as the base resin used for the rear electrode, or UV curable resins.

Figure 2:
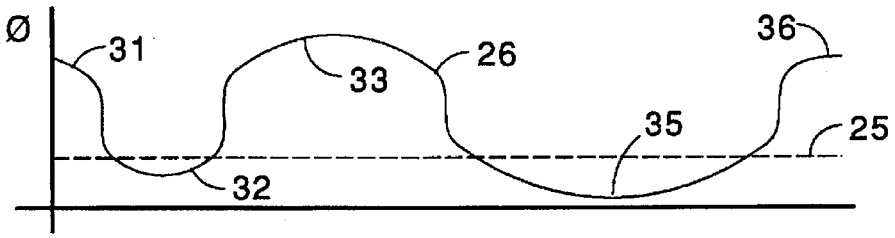
FIG. 2 is a curve representing electric field strength in the cross-section of FIG. 1.

FIG. 2 is a graph of the electric field across phosphor layer 15. Ordinate $\phi$ represents field strength and the abscissa represents the distance across the section illustrated in FIG. 1. Dotted line 25 represents the threshold field for causing the phosphor in layer 15 to produce a visible amount of light. Curve 26 represents the field strength across phosphor layer 15.

Portion 31 of curve 26 represents the field strength in the region to the left of insulating area 21, wherein the field strength is greater than threshold 25 and lamp 10 is luminous in that area. Portion 32 of curve 26 represents the region underlying insulating area 21. Because of the presence of insulating area 21, the field strength in phosphor layer 15 is reduced below threshold 25 and lamp 10 appears dark in the region underlying area 21. Portion 33 represents the field strength between insulating areas 21 and 22 wherein the field strength exceeds threshold 25 and the lamp appears luminous. The region underneath insulating area 22 is non-luminous and the area to the right of insulating area 22 is luminous, as indicated by portions 35 and 36.

Insulating areas 21 and 22 are preferably made from low dielectric constant material since a low dielectric constant material permits one to use a thin insulating layer for reducing field strength below the threshold for luminance. By using the same resin (but without conductive additives) as used for rear electrode 18, one obtains a patterned insulating layer which is compatible with other materials used in making an EL lamp. The resin used for insulating areas 21 and 22 is preferably clear or white. Suitable resins are readily available commercially such as UV curable "Plastic King III" mixing base, sold by Kolorcure of Batavia, Ill. Solvent based inks which are dried instead of UV cured include polyester "KC9627" sold by Naz-Dar Co. of Chicago, Ill. and solutions containing vinylidene fluoride resin powder sold by Elf Atochem of Philadelphia, Pa. The use of these resins is well known to those of skill in the art and the resins are used in many applications other than making EL lamps.

Figure 3:
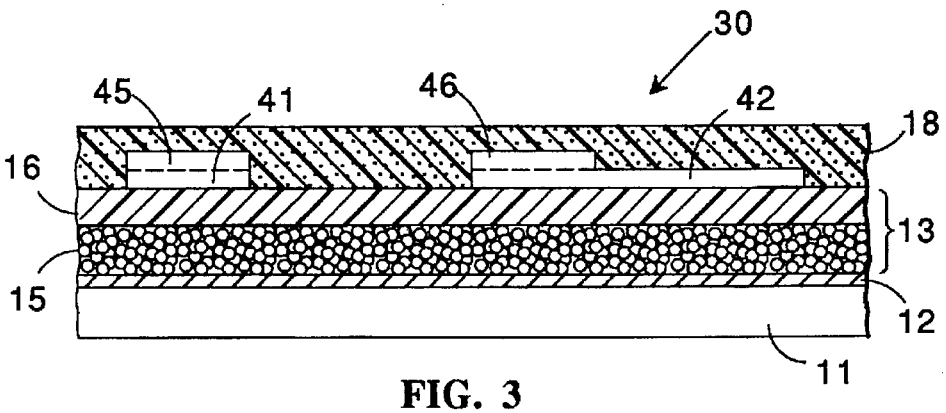
FIG. 3 is a cross-section of an EL lamp constructed in accordance with an alternative embodiment of the invention.

FIG. 3 is a cross-section of an EL lamp constructed in accordance with an alternative embodiment of the invention in which more than one brightness level is produced when the lamp is lit. Lamp 30 is similar to lamp 10 except that consecutive deposits are used to build up successive layers of insulating material. For example, in a first printing, a thin layer of insulating is deposited on dielectric layer 16, forming insulating areas 41 and 42. This layer is cured and then a second layer is deposited, producing insulating areas 45 and 46. Insulating area 45 is the same size and shape as insulating area 41. Insulating area 46 is smaller than insulating area 42 producing a change in thickness and a corresponding change in the electric field across phosphor layer 15.

Figure 4:
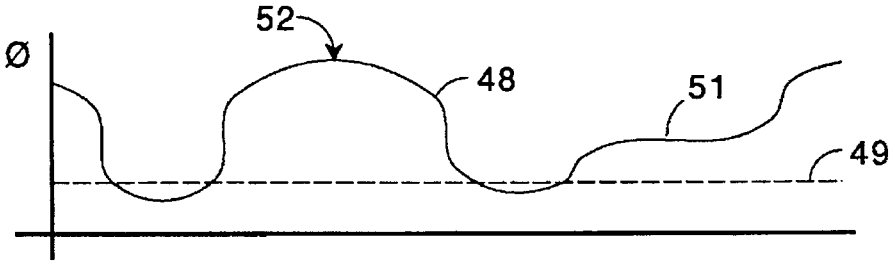
FIG. 4 is a curve representing electric field strength in the cross-section of FIG. 3.

In FIG. 4, curve 48 represents the electric field across electroluminescent dielectric layer 13 in FIG. 3. As indicated by curve 48, the region underneath insulating areas 41 and 45 has an electric field below threshold 49 and lamp 30 is dark in that region. The electric field between insulating areas 41 and 42 is greater than threshold 49 and the phosphor is luminous. Under insulating area 42 the electric field is partially below threshold 49 and partially above threshold 49, as determined by insulating areas 42 and 46. The region underneath insulating area 42 which is not covered by insulating area 46 is luminous but at a reduced level, as indicated by plateau 51. Since the field strength in plateau 51 is less than maximum field strength 52, lamp 30 exhibits three levels of brightness (high, low, off).

The number of brightness levels depends upon the number of different thicknesses of insulating material. It is not necessary that one provide a step change in thickness, i.e. the insulating areas can have a gradual rather than an abrupt change in thickness, e.g. by partially curing the underlying insulating area before depositing the next layer of insulating material. The consecutive depositions of insulating material are located by registration targets positioned outside the lamp area. Registration techniques are well known in themselves in the art.

Figure 5:
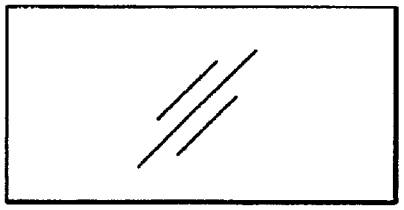
FIG. 5 is a front view of an unlit EL lamp constructed in accordance with the invention.
Figure 6:
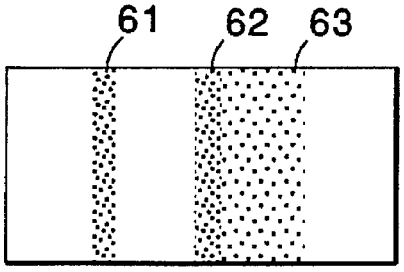
FIG. 6 is a front view of an lit EL lamp constructed as shown in FIG. 3.

FIG. 5 illustrates an unlit lamp constructed in accordance with the invention in which the lamp appears blank through the transparent electrode. In FIG. 6, a lamp constructed as shown in FIG. 3 includes dark areas 61 and 62, corresponding to insulating areas 45 and 46 and gray area 63, corresponding to the portion of insulating area 42 which does not underlie insulating area 46. While shown as simple stripes for the sake of illustration, the insulating areas can have any desired configuration. Closed figures and any number of separate, equally luminous letters or numbers can be provided without patterning either electrode. Although steps are added to the process for making an EL lamp, the remainder of the process is unchanged and unaffected, which simplifies implementing the invention.

Figure 7:
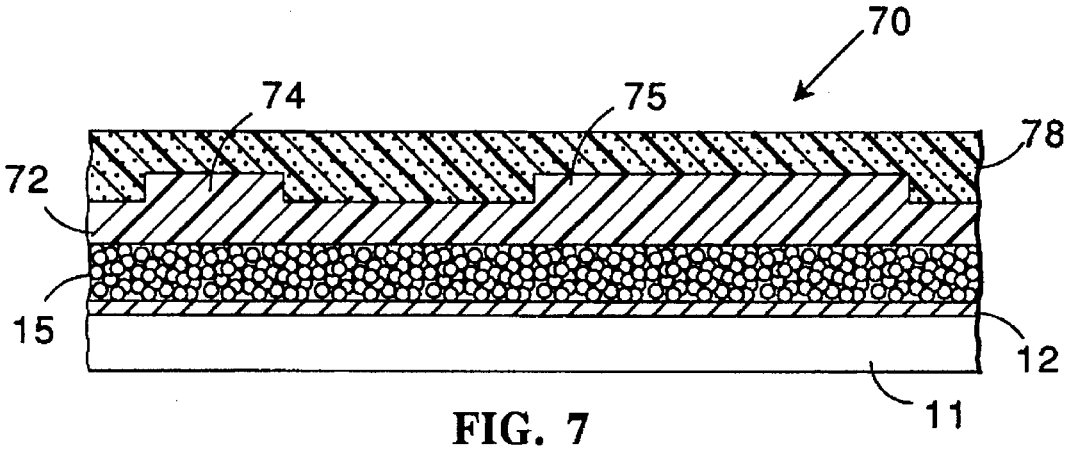
FIG. 7 is a cross-section of an EL lamp constructed in accordance with an alternative embodiment of the invention.

FIG. 7 is a cross-section of an EL lamp constructed in accordance with an alternative embodiment of the invention. As described above, the change in electric field is obtained by adding a layer of low dielectric constant insulating material. Dielectric layer 16 (FIG. 3) is also an insulating material but has a relatively high dielectric constant. In FIG. 7, dielectric layer 72 includes increased thickness portions 74 and 75 for reducing the electric field in selected areas across phosphor layer 15. Rear electrode 78 is deposited on dielectric layer 72, thereby completing lamp 70. The operation of lamp 70 is the same as lamp 10 in which a graphic is displayed only when lamp 70 is lit. There is no graphic visible through substrate 11 or transparent electrode 12.

Figure 8:
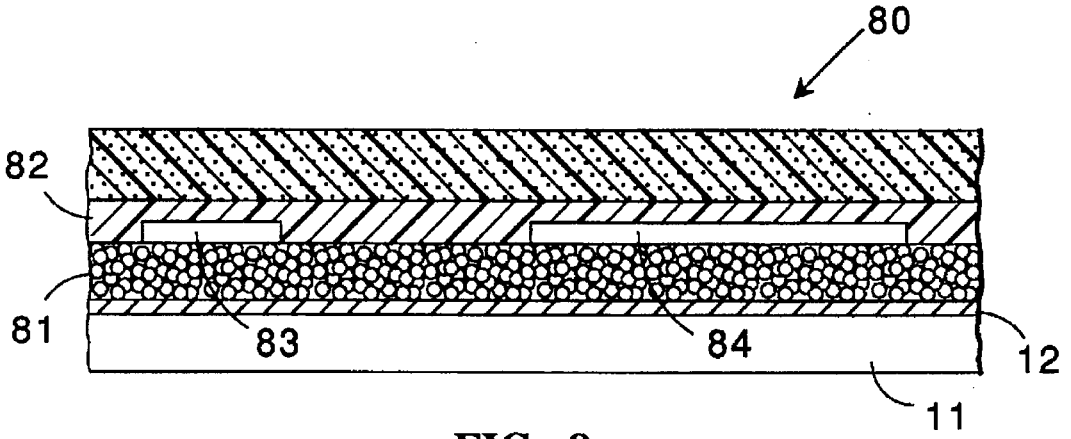
FIG. 8 is a cross-section of an EL lamp constructed in accordance with an alternative embodiment of the invention.

In FIG. 8, lamp 80 includes phosphor layer 81 having insulating areas 83 and 84 deposited thereon prior to deposition of dielectric layer 82. The insulating layer can be located anywhere within the sandwich of layers making up an EL lamp and has the same effect of reducing the electric field across portions of the phosphor layer to display graphics.

The invention thus provides an EL lamp which can display complex graphics, including gray scale, and can be constructed with continuous electrodes. The graphics are visible only when the lamp is lit. The shades of gray are independent of the area of each shade, separate lit areas have the same brightness, regardless of area, and the lamp can produce positive and negative graphics with equal ease.

Having thus described the invention, it will be apparent to those of skill in the art that various modifications can be made within the scope of the invention. For example, a mixture of dielectric material and phosphor can be used as the insulating layer and the phosphor in the insulating layer can have a different color from the continuous phosphor layer. If more than one insulating layer is used, the layers need not have the same dielectric constant or be the same material. A gray scale can also be produced in a single layer of uniform thickness from materials having different dielectric constants, e.g. area 21 (FIG. 1) is a first material and area 22 is a different material. A pre-patterned sheet of insulating material can be applied to the lamp from a hot die to make the insulating areas. An insulating layer can be patterned to produce a half-tone image.

What is claimed is:

1. A method for making an electroluminescent lamp capable of displaying graphics when lit and appearing plain when unlit, said method comprising the steps of:

depositing a conductive layer on a substrate;

depositing an electroluminescent layer on said conductive layer;

deposition a dielectric layer on said electroluminescent layer;

depositing an insulating layer either before or after depositing said dielectric layer, wherein said insulating layer is patterned in accordance with said graphics; and depositing a conductive layer.

2. The method as set forth in claim 1 wherein said step of depositing an insulating layer comprises the step of printing said insulating layer in a pattern corresponding to said graphics.

3. The method as set forth in claim 1 wherein said step of depositing an insulating layer comprises the step of printing said insulating layer in a pattern corresponding to the reverse of said graphics.

4. A method for displaying graphics in an electroluminescent lamp by controlling the electric field within said lamp, said method comprising the steps of:

depositing a continuous, transparent, conductive layer on a substrate;

depositing an electroluminescent layer on said transparent, conductive layer;

depositing on said electroluminescent layer a dielectric layer having increased thickness portions patterned in accordance with said graphics for reducing the electric field in said electroluminescent layer; and depositing a conductive layer on said dielectric layer.

5. The method as set forth in claim 1 wherein said insulating layer is deposited after the dielectric layer and said step of depositing said insulating layer comprises the steps of:

printing a first insulating layer in a first pattern;

printing a second insulating layer in a second pattern on said first insulating layer to produce an insulation layer of non-uniform thickness.

6. The method as set forth in claim 5 wherein the first printing step is followed by the step of partially curing said first insulating layer before printing the second insulating layer.

* * * * *